US007104844B2

(12) United States Patent
Akino

(10) Patent No.: US 7,104,844 B2
(45) Date of Patent: Sep. 12, 2006

(54) CONNECTOR FOR CONDENSER MICROPHONE

(75) Inventor: Hiroshi Akino, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 11/271,888

(22) Filed: Nov. 14, 2005

(65) Prior Publication Data

US 2006/0105602 A1 May 18, 2006

(30) Foreign Application Priority Data

Nov. 15, 2004 (JP) ..... 2004-330002

(51) Int. Cl.
*H01R 13/66* (2006.01)

(52) U.S. Cl. ..... 439/620.21

(58) Field of Classification Search ..... 439/620, 439/621, 622

See application file for complete search history.

(56) References Cited

U.S. PATENT DOCUMENTS 4,722,225 A * 2/1988 Hardy et al. ..... 73/622
4,772,225 A * 9/1988 Ulery ..... 439/620.09
6,987,659 B1 * 1/2006 Epstein ..... 361/220
2005/0148227 A1 * 7/2005 Akino ..... 439/218
2005/0185807 A1 * 8/2005 Akino ..... 381/174
2005/0254670 A1 * 11/2005 Akimo ..... 381/113

* cited by examiner

*Primary Examiner*—Phuong Dinh
(74) *Attorney, Agent, or Firm*—Manabu Kanesaka

(57) ABSTRACT

A 3-pin type output connector for a condenser microphone includes a grounding first pin and second and third pins for signals, provided on a connector base made of an electric insulator. Each pin contains a chip type inductor element that inhibits a high-frequency current, and includes a pin main body provided on the connector base, a cylindrical chip holder made of an electric insulator and having one end attached to an end of the pin main body located inside the microphone case, and a metal cap that covers the other end of the chip holder so as to be electrically insulated from the pin main body. The chip type inductor element is placed in the chip holder, and the pin main body and the cap are electrically connected via the chip type inductor element.

3 Claims, 2 Drawing Sheets

CONNECTOR FOR CONDENSER MICROPHONE

TECHNICAL FIELD

The present invention relates to an output connector for a condenser microphone, and more specifically, to a technique for preventing an electromagnetic wave of a high frequency generated by, for example, a cellular phone from entering a microphone case through an output connector.

BACKGROUND ART

A microphone unit of a condenser microphone has a very high impedance and thus contains an impedance converter such as an FET (Field Effect Transistor) or a vacuum tube. Normally, a phantom power source is used for the condenser microphone. A microphone sound signal is output via a balanced shield cable for the phantom power source.

To connect to the balanced shield cable, a microphone case (in a hand-held microphone, a microphone grip) is provided with a 3-pin type output connector (see, for example, Japanese Patent Application Publication No. H11-341583). The output connector is defined in EIAJ RC-5236 " latch lock type round connector for audio equipment. The configuration of the output connector will be described with reference to FIGS. 3 to 5.

FIG. 3 is a sectional view showing an output connector installed in a microphone case. FIG. 4 is a front view showing the output connector removed from the microphone case. FIG. 3 is a section view of the output connector taken along line 3—3 in FIG. 4. FIG. 5 is a plan view of the output connector.

In this microphone, an output connector 10 comprises a disk-like connector base 11 consisting of an electric insulator such as a PBT (poly butadiene terephthalate) resin. The connector base 11 has three pins, that is, a grounding first pin E, a second pin SH for a hot side of a signal, and a third pin SC for a cold side of the signal, penetratingly installed by, for example, press fitting.

For a hand-held microphone, as shown in FIG. 3, the output connector 10 is installed in a connector housing cylinder 20 screwed to an end of a microphone grip. Normally, the microphone grip, including the connector housing cylinder 20, consists of a metal material such as brass. The microphone grip also serves as a shield case for contained electric parts.

An external thread 12 is formed in the connector base 11; the external thread 12 is used to fix the output connector 10 to the connector housing cylinder 20 and to electrically connect the grounding first pin E to the connector housing cylinder 20.

The external thread 12 is housed in a thread housing hole 13 drilled in the connector base 11 in its radial direction. The connector base 11 is provided with an earth terminal block 14 having an internal thread 14*a* engaged with the external thread 12 in the thread housing hole 13.

As shown in the plan view in FIG. 5, the earth terminal block 14 and the grounding first pin E are electrically connected together via a metal connection member 15. As shown in FIG. 3, the external thread 12 is rotated through a hole 21 drilled in the connector housing cylinder 20, using a driver (not shown). The male thread 12 is thus abutted against the periphery of the hole 21.

This electrically connects the grounding first pin E to the connector housing cylinder 20 via the external thread 12, earth terminal block 14, and metal connection member 15.

Alternatively, as shown in FIGS. 4 and 5, a leaf spring 16 may be connected to the grounding first pin E to electrically connect the grounding first pin E to the connector housing cylinder 20; the leaf spring 16 contacts an inner surface of the connector housing cylinder 20.

When a microphone cable (balanced shield cable) drawn from a phantom power source (not shown) is connected to the output connector 10, if an intense electromagnetic wave is applied to the microphone or microphone cable, it may enter the microphone through the output connector 10. Then, the electromagnetic wave may be demodulated by an impedance converter and then output by the microphone as noise of an audible frequency.

The operation described below is conventionally used as a method for preventing an electromagnetic wave from entering the microphone through the output connector 10. A condenser is connected between the grounding first pin E and the hot-side second pin SH and between the grounding first pin E and the cold-side third pin SC; the condensers operate to short high frequencies. Further, the hot-side second pin SH and the cold-side third pin SC are connected to the microphone case such as the connector housing cylinder 20 via an inductor that inhibits the entry of high frequencies.

The above conventional technique can inhibit the entry of normal broadcasting electric waves, for example, electromagnetic waves of HF, VHF, or UHF without any problems. However, the recent prevalence of cellular phones and the like has increased the opportunities to use an electromagnetic wave of a higher frequency near the microphone.

The three pins E, SH, and SC of the output connector 10 are located directly inside the microphone case. Consequently, a high-frequency current may enter the microphone case through these pins, the high-frequency current resulting from an intense electromagnetic wave radiated by a cellular phone or the like. The high-frequency current then reaches an electronic circuit including an impedance circuit, by radiation or propagation to generate noise.

In particular, noise is made when a high-frequency current coming from the hot-side second pin SH or cold-side third pin SC is electrostatically coupled to the electronic circuit. In other cases, noise is made when high-frequency magnetic fields generated by a high frequency current flowing through the microphone case are magnetically coupled.

SUMMARY OF THE INVENTION

It is thus an object of the present invention to prevent a high-frequency current from entering a microphone case via a pin penetratingly provided on an output connector; the high-frequency current results from an electromagnetic wave radiated by a cellular phone.

To accomplish this object, the present invention provides an output connector of a 3-pin type in which three pins, a grounding first pin and second and third pins for signals are penetratingly provided on a connector base comprising an electric insulator, the first pin being installed at an end of a conductive microphone case of a condenser microphone so as to electrically connect to the microphone case, wherein each of the pins contains a chip type inductor element that inhibits a high-frequency current.

According to the present invention, each pin contains the chip type inductor element that inhibits a high-frequency current as a choke coil. This reliably prevents the high-frequency current from entering the microphone case via the pin. It is thus possible to effectively suppress the generation of noise resulting from an electromagnetic wave.

In a more preferable aspect, each of the pins comprises a pin main body penetratingly provided on the connector base, a cylindrical chip holder comprising an electric insulator and having one end attached to an end of the pin main body which is located inside the microphone case, and a metal cap that covers the other end of the chip holder so as to be electrically insulated from the pin main body, the chip type inductor element is placed in the chip holder, and the pin main body and the cap are electrically connected via the chip type inductor element.

Further, an elastic conductive material is placed between one terminal portion of the chip type inductor element and the pin main body and between the other terminal portion of the chip inductor element and the cap. Thus, even if an external stress is applied to the pin, particularly its cap side, the chip type inductor element can be protected from the external stress. Further, a reliable electric connection state can be established.

Moreover, a metal net is used as the conductive material. This makes it possible to reduce the resistance value of the connected part. Furthermore, the metal net can be easily obtained and machined and is inexpensive. This minimizes an increase in costs associated with the containment of the chip type inductor element in the pin.

DETAILED DESCRIPTION

Figure 1A:
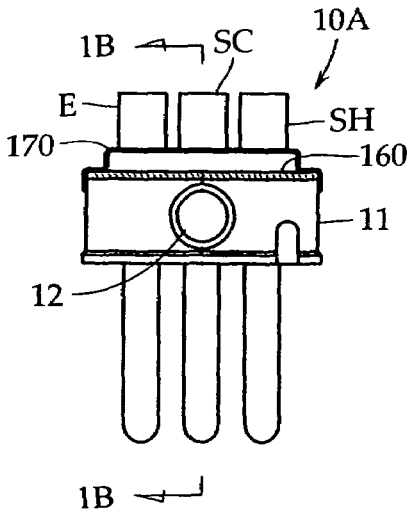
FIG. 1A is a front view showing an output connector in accordance with the present invention.
Figure 1B:
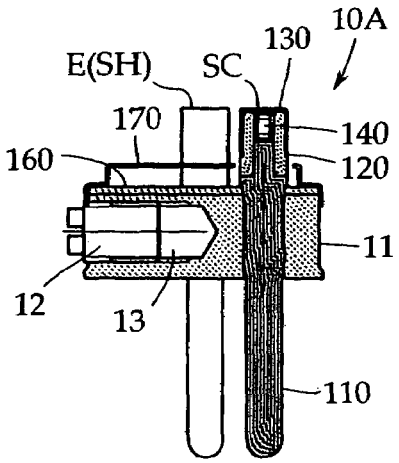
FIG. 1B is a sectional view taken along line 1B—1B in FIG. 1A.
Figure 2:
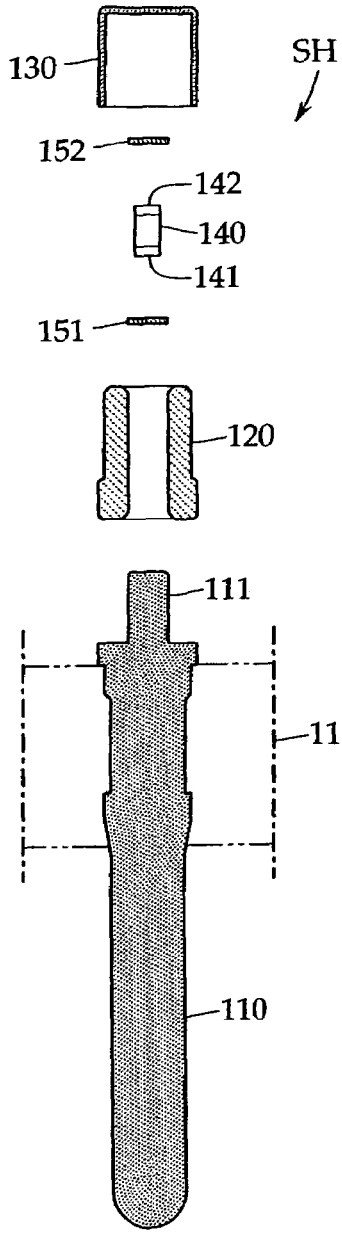
FIG. 2 is an exploded sectional view showing one of the pins of the output connector.
Figure 4:
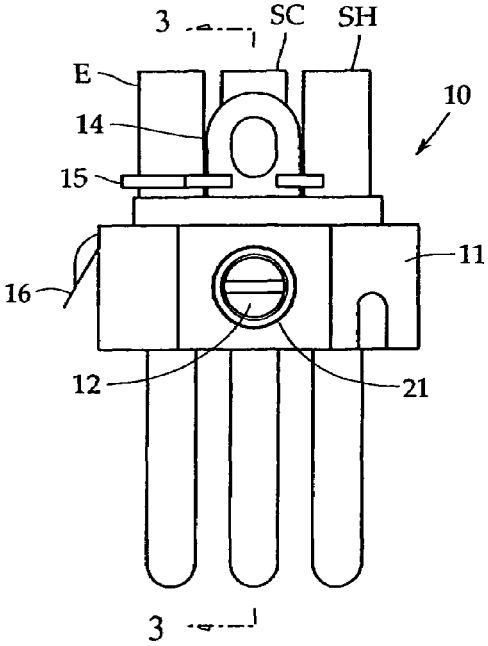
FIG. 4 PRIOR ART
FIG. 4 is a front view showing the conventional output connector.
Figure 5:
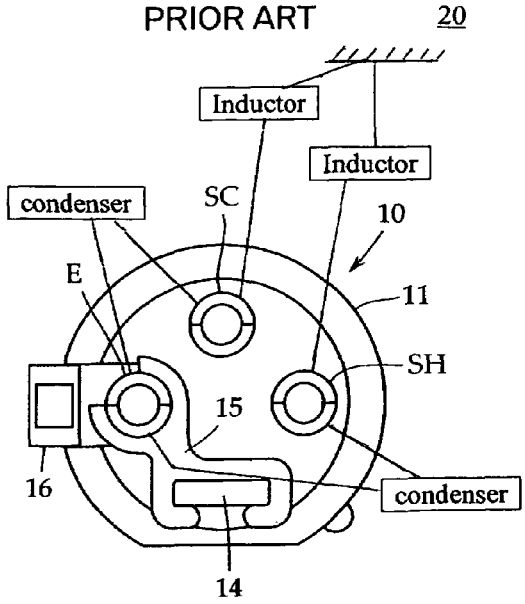
FIG. 5 PRIOR ART
FIG. 5 is a plan view showing the conventional output connector.

Now, an embodiment of the present invention will be described with reference to FIGS. 1A, 1B and 2. However, the present invention is not limited to this. FIG. 1A is a front view showing an output connector 10A in accordance with the present invention. FIG. 1B is a sectional view taken along line 1B—1B in FIG. 1A. FIG. 2 is an exploded sectional view showing one of three pins. The same reference numerals as those in the conventional example described with reference to FIGS. 3 to 5 are used for those components which are the same as or may be considered to be the same as those of the conventional example.

As shown in FIGS. 1A and 1B, an output connector 10A in accordance with the present invention is defined in EIAJ RC-5236 "latch lock type round connector for audio equipment". The basic configuration of the output connector 10A may be the same as that of the output connector 10, described as the conventional example.

That is, the output connector 10A comprises a connector base 11 formed of a synthetic resin such as PBT so as to have a disk shape. The connector base 11 has three pins, that is, a grounding first pin E, a second pin SH for a hot side of a signal, and a third pin SC for a cold side of the signal, penetratingly installed by, for example, press fitting. FIG. 1B is a sectional view corresponding to FIG. 1A. Accordingly, in FIG. 1B, the hot-side second pin SH is located closer to the reader than the grounding first pin E in the sheet of the drawing.

Figure 3:
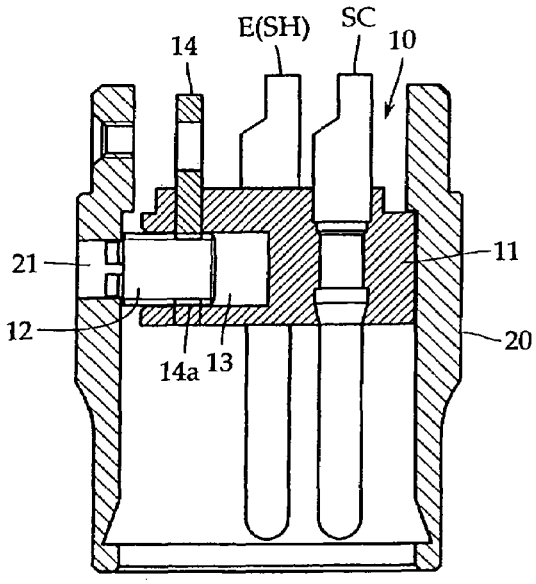
FIG. 3 PRIOR ART
FIG. 3 is a sectional view taken along line 3—3 in FIG. 4 showing a conventional output connector installed in a connector housing section.

Further, the connector substrate 11 is provided with an external thread 12 for fixation to the connector housing section 20 (see FIG. 3). However, in FIGS. 1A and 1B, the following are not illustrated: an earth terminal block 14 having an internal thread 14*a* engaged with the fixing external thread 12 and a metal connection member 15 that connects the earth terminal block 14 to the grounding first pin E. Furthermore, a leaf spring 16 may be provided for the first pin E; the leaf spring 16 contacts an inner surface of the connector housing section 20. See FIGS. 3 to 5 for the earth terminal block 14, metal connection member 15, and leaf spring 16.

According to the present invention, each of the pins of the output connector 10A contains a chip type inductor element 140 serving as a choke coil to inhibit high frequencies. The configuration of the chip type inductor element 140 will be described taking the case of the exploded sectional view of the signal cold-side third pin SC shown in FIG. 2

The third pin SC comprises a metal pin main body 110 penetratingly provided on the connector base 11. In FIG. 2, an upper end of the pin main body 110 which projects upward from the connector base 11 is placed in the microphone case (not shown). A connection plug of a balanced shield cable for a phantom power source (not shown) is connected to a round bar portion of the pin main body 10 which projects downward from the connector base 11.

A cylindrical chip holder 120 is attached to the upper end of the pin main body 110; the chip holder 120 consists of an electric insulator, for example, a synthetic resin. In this example, a boss 111 is projectingly provided in the center of the upper end of the pin main body 110. The chip holder 120 is fitted around the boss 111. For example, an adhesive may be used to fix the chip holder 120 to the pin main body 110. The chip holder 120 may also be frictionally engaged with the pin main body 110. Alternatively, the chip holder 120 may be fixed to the upper end of the pin main body 110 using an adhesive and without providing the boss 111.

The chip type inductor element 140 is housed in the chip holder 120. The chip type inductor element 140 comprises soldering terminal portions 141 and 142 at its opposite ends. One 141 of the terminal portions is housed in the chip holder 120 so as to contact the pin main body 110 (in this example, the boss 111).

A metal cap 130 serving as a terminal (terminal block) covers the upper end of the chip holder 120. The cap 130 may be fixed using an adhesive or by frictional engagement. The cap 130 contacts only the other terminal portion 142 of the chip type inductor element 140 and not the pin main body 110. This allows the cap 130 and the pin main body 110 to be electrically connected via the chip type inductor element 140.

To protect the chip type inductor element 140 from an external stress applied to the cap 130 and to improve the reliability of electric connections, elastic conductive materials 151 and 152 are preferably interposed between one 141 of the terminal portions of the chip type inductor element 140 and the pin main body 110 (in this example, the boss 111) and between the other terminal portion 142 of the chip type inductor element 140 and the cap 130, respectively.

The conductive materials 151 and 152 of this kind may be rubber connectors (commonly known as zebra rubber), conductive rubber, metal nets, or the like. The metal nets are preferably adopted because of their small connection resistance, high availability and machinability, and low price.

The metal nets have a thickness appropriately selected so as to fill the gaps between the chip type inductor element 140 and the pin main body 110 and between the chip type inductor element 140 and the cap 130.

By thus building the chip type inductor element 140 into the pin of the output connector 10A, the choking action of the chip type inductor element 140 inhibits a high-frequency current resulting from an electromagnetic wave radiated by a cellular phone. This makes it possible to prevent the high-frequency current, which is a source of noise, from entering the microphone case via the pin.

Similarly, the first pin E and the second pin SH preferably contain the chip type inductor element 140. However, of the three pins E, SH, and SC, for example, the second pin SH and the third pin SC may contain the chip type inductor element 140. Alternatively, only the first pin E may contain the chip type inductor element 140.

An example of the chip type inductor element 140 that can be housed in the pin of the output connector 10A is the HFB series manufactured by Denken Sangyo Sha. This chip type inductor element has a function for suppressing noise of a GHz band and has a length of 1.6 mm, a width of 0.8 mm, and a height of 0.8 mm. The chip type inductor element can be easily integrated into the pin.

Further, to ensure the entry of a high-frequency current into the microphone case, a condenser (not shown) operating to short high frequencies is preferably connected between the grounding first pin E and the hot-side second pin SH and between the grounding first pin E and the cold-side third pin SC.

Moreover, as shown in FIGS. 1A and 1B, a printed circuit board 160 and a shield cover 170 may be provided on an inner surface of the connector base 11 which is located inside the microphone case; the printed circuit board 160 has a solid pattern of a copper foil on at least one surface. In this case, the solid pattern of the printed circuit board 160 is electrically connected only to the grounding first pin E and not to the second pin SH or third pin SC.

The present application is based on, and claims priority from, Japanese Application Serial Number JP2004-330002, filed Nov. 15, 2004, the disclosure of which is hereby incorporated by reference herein in its entirety.

The invention claimed is:

1. An output connector of a 3-pin type in which three pins comprising a grounding first pin and second and third pins for signals are penetratingly provided on a connector base made of an electric insulator, the first pin being installed at an end of a conductive microphone case of a condenser microphone so as to electrically connect to the microphone case, wherein each of the pins contains a chip type inductor element that inhibits a high-frequency current, and wherein each of the pins comprises a pin main body penetratingly provided on the connector base, a cylindrical chip holder comprising an electric insulator and having one end attached to an end of the pin main body which is located inside the microphone case, and a metal cap that covers the other end of the chip holder so as to be electrically insulated from the pin main body, the chip type inductor element is placed in the chip holder, and the pin main body and the cap are electrically connected via the chip type inductor element.

2. The output connector for the condenser microphone according to claim 1, wherein an elastic conductive material is placed between one terminal portion of the chip type inductor element and the pin main body and between the other terminal portion of the chip inductor element and the cap.

3. The output connector for the condenser microphone according to claim 2, wherein a metal net is used as the conductive material.

* * * * *